United States Patent [19]

Dettke et al.

[11] Patent Number: 4,517,060

[45] Date of Patent: May 14, 1985

[54] METHOD AND BATH FOR ELECTRODEPOSITING A VIOLET-COLORED GOLD-COPPER-BISMUTH ALLOY

[75] Inventors: Manfred Dettke; Rudolf Klein, both of Berlin, Fed. Rep. of Germany

[73] Assignee: Schering Aktiengesellschaft, Berlin and Bergkamen, Fed. Rep. of Germany

[21] Appl. No.: 615,471

[22] Filed: May 29, 1984

[30] Foreign Application Priority Data

May 27, 1983 [DE] Fed. Rep. of Germany ..... 3319772

[51] Int. Cl.[3] ..... C25D 3/62

[52] U.S. Cl. ..... 204/44

[58] Field of Search ..... 204/44, 123

[56] References Cited

U.S. PATENT DOCUMENTS 4,199,416 4/1980 Middleton et al. ..... 204/44

*Primary Examiner*—G. L. Kaplan

*Attorney, Agent, or Firm*—Michael J. Striker

[57] ABSTRACT

An aqueous bath is disclosed for the galvanic deposition of uniformly rose to violet colored gold alloys and containing an alkali- or ammonium-dicyanoaurate-I, alkali copper cyanide, alkali cyanide and a bismuth compound which is a water-soluble complex compound of bismuth. Also disclosed is a method for the galvanic deposition of the alloys and employing the particular bath.

15 Claims, No Drawings

METHOD AND BATH FOR ELECTRODEPOSITING A VIOLET-COLORED GOLD-COPPER-BISMUTH ALLOY

BACKGROUND OF THE INVENTION

The invention concerns an aqueous bath for the galvanic deposition of uniform rose to violet colored gold alloys, containing an alkali- or ammonium-dicyanoaurate-I, alkali copper cyanide, alkali cyanide, a bismuth compound as well as, if necessary, organic wetting agent and lustrant.

Bismuth-containing baths are already known and from which 2 or 3 substance containing alloys can be electrolytically deposited. As a rule, bismuth trifluoride or bismuth triperchlorate respectively alkali-bismutate are employed as bismuth compounds, and of which the former only within acid range and the latter only within strongly alkaline range can be employed, since these compounds are difficultly soluble within the pH range from 6 to 13.

Baths of these compositions are without technical significance per se, since they are non-stable and allow for the deposition only of coatings with little lustre.

SUMMARY OF THE INVENTION

It is therefore an object of the present invention to provide for the availability of a stable bismuth-containing gold alloying bath which makes possible the deposition of more lustrous ternary gold alloys having a high content of bismuth.

This object is attained according to the present invention by means of an aqeous bath of the above described type which may thereby be characterized in that it contains a water-soluble complex compound of bismuth as bismuth compounds.

SUMMARY OF THE INVENTION

The bath according to the present invention is suitable in outstanding manner for the deposition of lustrous rose to violet coloration ternary gold alloys onto decorative objects such as for example, jewelry, timepieces, eyeglass frames, which is not possible with the known baths of similar composition.

It is of particular technical significance that the bismuth in the alloys is incorporated at extraordinarily contents up to 30% by weight and higher, wherewith further areas of use are inferred.

Thus, for example, the bath according to the present invention is in surprising manner also suitable for the finishing of electronic components, such as plug connections, since the herewith separated precipitates are particularly hard and display a good electrical conductivity as well as an outstanding resistance to friction.

As complex compounds according to the present invention mention may be made in particular of those of bismuth with organic phosphonic acids, carboxylic acids or amino alcohols.

Phosphonic acids suitable for formation of the water-soluble complex compounds of bismuth according to the present invention include, for example, those of the general formula $$R'_{(3-n)}-N-[R-\overset{\overset{\displaystyle O}{\|}}{P}-(OH)_2]_n, \qquad \text{I}$$

in which R′ is hydrogen or $C_1$–$C_3$ alkyl such as methyl, ethyl or propyl, R is $C_1$–$C_3$ alkylene, such as methylene, ethylene, or trimethylene, and n is a whole number from 1 to 3.

Particularly suitable phosphonic acids include by way of example the following ethylenediaminetetramethylphosphonic acid, 1-hydroxyethanediphosphonic acid and 2,3-dihydroxypropylphosphonic acid.

Moreover, carboxylic acids can also be employed, which for example, correspond to the following general formulae $$NX_3 \qquad \text{II}$$

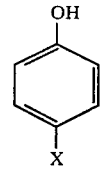

III or

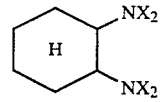

IV wherein X is the group $$-[(CHR_1)_n-COOH]$$

with $R_1$ signifying hydrogen, $C_1$–$C_3$-alkyl, such as methyl, ethyl or propyl, and n is a whole number from 1 to 3.

More particularly suitable carboxylic acids include by way of example the following nitrilotriacetic acid, 4-oxyphenylmalonic acid and 1,2-diaminocyclohexanetetra-acetic acid.

Moreover suitable carboxylic acids are further polyhydroxy acids to which special attention must be called, such as D-saccharic acid, d-manosaccharic acid, mucic acid, 1,2,3,4-tetrahydroxybutane-1,1,4-tricarboxylic acid and 3,4,5-trihydroxybenzoic acid.

Amino alcohols suitable for the complexing are, finally, those of the general formula $$[R_2-CHOH-(CH_2)_n]_2-N-(CH_2)_n-N-[(CH_2)_n-CH.OH-R_2]_2 \qquad \text{V}$$

wherein $R_2$ is hydrogen or $C_1$–$C_{13}$ -alkyl, such as methyl, ethyl or propyl, and n is the number 1 or 2.

Ethylene diaminotetraisopropyl alcohol is mentioned by way of example as a particularly suitable alcohol.

The soluble complex compounds of bismuth can be prepared before their employment according to the present invention by for example reacting the complexing agent when bismuth hydroxide or bismuth nitrate in aqeous solution and at a mol ratio from 1 mol bismuth to 1 to 4 mol complexing agent at room temperature. It is also, however, possible to add bismuth hydroxide or bismuth nitrate complexing agent directly to the bath solution.

In general an aqueous solution is employed as bath, which contains alkali- or ammoniumdicyanoaurate-1, alkali copper cyanide, alkali cyanide, and the water-soluble complex compound of bismuth. The preferred concentrations amount to:

Alkali or ammonium dicyanoaurate: 0.5–15 g/liter
alkali copper cyanide: 20.0–200 g/liter *
complex compound or bismuth: 2.0–30 g/liter
alkali cyanide: 0.1–50 g/liter

*measured as bismuth

Advantageously, sodium and potassium salts are employed as the alkali salt.

The bath can in addition, contain customary wetting agent of a non-ionogenic, cation- or anion-active nature as additive substance. These materials can moreover be effective as lustrant, and indeed at concentrations from 0.01 up to 20 g/liter.

The pH value can amount to from 6 to 13, indeed according to the employed complex former and is adjusted if desired by means of the addition of alkali hydroxide.

The bath is appropriately driven at temperatures from 20° up to 70° C., whereby preferred current densities from 0.1 up to 3 A/dm$^2$ come into use.

The novel features which are considered characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

EXAMPLE 1

| | | |
|---|---|---|
| potassiumdicyanoaurate-I | $KAu(CN)_2$ | 4.5 g/liter |
| potassium copper cyanide | $K_2Cu(CN)_3$ | 200.0 g/liter |
| bismuth hydroxide | $Bi(OH)_3$ | 15.0 g/liter |
| potassium cyanide | KCN | 20.0 g/liter |
| ethylenediaminetetramethyl-phosphonic acid | | 50.0 g/liter |
| alkylphenolpolyglycolether | | 0.2 g/liter |

The pH-value of 11.5 is adjusted with potassium hydroxide.

At an average current density of 0.4 A/dm$^2$ a rose-colored coating with a fineness of 750/000 is deposited. The coating displays a hardness of HK420.

EXAMPLE 2

| | | |
|---|---|---|
| potassiumdicyanoaurate-I | $KAu(CN)_2$ | 4/0 g/liter |
| potassium copper cyanide | $K_2Cu(CN)_3$ | 150.0 g/liter |
| bismuth hydroxide | $Bi(OH)_3$ | 20.0 g/liter |
| potassium cyanide | KCN | 0.5 g/liter |
| 1,2-diaminocyclohexanetetra-acetic acid | | 30.0 g/liter |
| sodiumlaurylsulfate | | 1.0 g/liter |
| pH value | 7.5 | |
| temperature | 65 C. | |
| current density | 0.5 A/dm$^2$ | |

Precipitates are separated from the electrolytes and with a fineness of 85/000. The coatings have an unexpectedly high corrosion resistance and behave outstandingly in the abrasion test.

EXAMPLE 3

| | | |
|---|---|---|
| potassiumdicyanoaurate-I | $KAu(CN)_2$ | 4.5 g/liter |
| potassium copper cyanide | $K_2Cu(CN)_3$ | 110.0 g/liter |

-continued

| | | |
|---|---|---|
| bismuth nitrate | $Bi(NO_3)_3.5H_2O$ | 21.0 g/liter |
| potassium cyanide | KCN | 3.0 g/liter |
| lactic acid | | 60.0 g/liter |
| ethoxylated fatty amine with ca. 30 mol ethyleneoxide | | 2.0 g/liter |
| pH value | 9.5 | |
| temperature | 65° C. | |
| current density | 0.3–0.5 A/dm$^2$ | |

Precipitates are separated from these electrolytes with a fineness of 650/000. The solderability is excellent. The corrosion resistance is good since the coatings are already pore-free after 1 $\mu$m.

It will be understood that each of the elements described above, or two or more together, may also find a useful application in other types of metalization baths differing from the types described above.

While the invention has been illustrated and described as embodied in a bath for the galvanic deposition of gold alloys, it is not intended to be limited to the details set forth, since various modifications and structural alterations may be made without departing in any way from the spirit of the present invention.

Without further analysis, the foregoing will reveal the gist of the present invention that others can, by applying the current knowledge, readily adapt it for various applications without omitting features, that from the standpoint of prior art, fairly constitute essential characteristics of the generic or specific aspects of this invention.

What is claimed as new and desired to be protected by Letters Patent is set forth in the appended claims.

We claim:

1. Aqueous bath for the galvanic deposition of uniformly rose to violet-colored gold alloys, comprising
an alkali- or ammonium-dicyanoaurate-I,
an alkali copper cyanide,
an alkali cyanide and
a water-soluble complex compound of bismuth.

2. The aqueous bath according to claim 1, wherein said water-soluble complex compound is a complex compound of bismuth with an organic phosphonic acid, a carboxylic acid or an amino alcohol.

3. The aqueous bath according to claim 1, wherein said complex compound is of bismuth with ethylenediaminetetramethylphosphonic acid, 2,3-dihydroxypropylphosphonic acid, 1-hydroxyethanediphosphonic acid, nitrilotriacetic acid, 4-oxyphenylmalonic acid, 1,2-diaminocyclohexanetetra acetic acid, d-saccharic acid, d-mannosaccharic acid, mucic acid, 1,2,3,4-tetrahydroxidebutane-1,1,4-tricarboxylic acid, 3,4,5-trihydroxybenzoic acid or ethylenediaminetetraisopropylalcohol.

4. The aqueous bath according to claim 1, wherein said complex compound is present in a concentration from 10 mg/liter to 100 g/liter measured as bismuth.

5. The aqueous bath according to claim 4, wherein said concentration is from 5 to 20 g/liter.

6. The aqueous bath according to claim 1, wherein said complex compound comprises bismuth and complex former in a mol ratio from 1:1 to 1:4.

7. The aqueous bath according to claim 1, displaying a pH value from 6 to 13.

8. The aqueous bath according to claim 1, further comprising wetting agent means of a non-ionogenic cation- or anion-active nature.

9. The aqueous bath according to claim 8, wherein said wetting agent means are present in a concentration from 0.01 to 20 g/liter.

10. Method for the electrolytical deposition of gold alloy, comprising providing an aqueous bath according to claim 1, introducing into said bath an object for deposition and allowing gold alloy to coat said object.

11. The method according to claim 10, further allowing said gold alloy to coat said object to an extent of at least 1 $\mu$m.

12. The method according to claim 10, further comprising providing in said bath said complex compound in a concentration from 10 g/liter to 100 g/liter.

13. The method according to claim 10, further comprising providing in said bath a pH-value from 6 to 13.

14. The method according to claim 10 wherein the bath has a temperature from 20° to 70° C.

15. The method according to claim 10 wherein a cathodic current density from 0.1 to 3 A/dm.$^2$ is used.

* * * * *